US006130595A

United States Patent [19]

Niimi

[11] Patent Number: 6,130,595

[45] Date of Patent: Oct. 10, 2000

[54] ELECTROMAGNETIC SWITCH

[75] Inventor: Masami Niimi, Handa, Japan

[73] Assignee: Denso Corporation, Kariya, Japan

[21] Appl. No.: 09/317,640

[22] Filed: May 25, 1999

[30] Foreign Application Priority Data

May 28, 1998 [JP] Japan ..... 10-147597

[51] Int. Cl.[7] ..... H01F 3/00; H01F 7/08

[52] U.S. Cl. ..... 335/279; 335/255; 335/261

[58] Field of Search ..... 335/255, 261, 335/279

[56] References Cited

U.S. PATENT DOCUMENTS

| | | | |
|---|---|---|---|
| 3,699,486 | 10/1972 | De Lucia | 335/131 |
| 3,740,171 | 6/1973 | Farkos | 417/418 |
| 5,174,336 | 12/1992 | Casey et al. | 137/625.5 |

FOREIGN PATENT DOCUMENTS 2646893 5/1997 Japan .

OTHER PUBLICATIONS

CRC Handbookof tables for Applied Engineering Science, p. 617, 1970.

*Primary Examiner*—Michael L. Gellner
*Assistant Examiner*—Raymond Barrera
*Attorney, Agent, or Firm*—Pillsbury Madison & Sutro LLP

[57] ABSTRACT

An electromagnetic switch has a solenoid coil, a sleeve and a movable core which slides in the sleeve. A metal thin film is formed on an outer peripheral surface of the movable core by electroplating. The metal thin film is harder than the inner surface of the sleeve, and has high melting point and high smoothness. Accordingly, adhesive wear between the sleeve and the movable core is reduced, and sliding durability under high temperature is improved.

16 Claims, 2 Drawing Sheets

ELECTROMAGNETIC SWITCH

CROSS REFERENCE TO RELATED APPLICATION

This application is based upon and claims priority from Japanese Patent Application No. H. 10-147597 filed May 28, 1998, the contents of which are incorporated herein by reference.

BACKGROUND OF THE INVENTION

1. Field of the Invention

The present invention relates to an electromagnetic switch, and is desirably applicable to an electromagnetic switch for a starter of a vehicle.

2. Description of Related Art

A known electromagnetic switch for a starter, which has high durability for sliding and high protection against corrosion at a sliding surface between a movable core and a metal sleeve, is disclosed in Japanese Patent No. 2646893.

The prior art electromagnetic switch is characterized in that a metal film, which is softer than the outer peripheral surface of the metal sleeve and has a small potential difference with the metal sleeve, is formed on an outer periphery of the movable core.

Specifically, the soft metal film, which has Vickers hardness of Hv30 nd is made of tin (Sn), is formed on the outer peripheral surface of the movable core made of mild steel. The metal sleeve is made of brass or stainless steel. The movable core slides on the inner surface of the sleeve via the metal film. The high durability for sliding is obtained because the soft metal film functions as a lubrication layer. At the same time, the electrolytic corrosion is prevented even under submergence because the potential difference between the movable core and the metal sleeve is reduced by covering the movable core with tin.

However, when an electromagnetic switch is applied to a starter, it may be required to reduce in size to accommodate it in the engine compartment and is also required higher output. Furthermore, more electromagnetic force may be required to drive a pinion gear of a starter motor via a drive lever in addition to actuating the switch. Further, since some drivers may keep operating the starter motor for long period, Joule heat generated at a solenoid coil may raise the temperature of the electromagnetic switch considerably.

More specifically, the sliding surface between the movable core and the metal sleeve may reach 250° C. In that case, heat resistance may not be sufficient because the melting point of tin is 212° C.

SUMMARY OF THE INVENTION

The present invention is made in light of the foregoing problem, and it is an object of the present invention to provide an electromagnetic switch which can improve the sliding durability at a sliding portion between a movable core and a sleeve under high temperature.

According to an electromagnetic switch of the present invention, it has a sleeve made of a first metal, a solenoid coil wound around the sleeve for generating a magnetic force when energized, a movable core fitted in the sleeve movably in response to the magnetic force, and a metal layer formed between the movable core and the sleeve. The metal layer is made of a second metal having a hardness higher than that of the first metal. Accordingly, the sliding durability is improved.

According to another aspect of the present invention, the metal layer has a melting point higher than 400° C. Accordingly, the sliding durability is improved under high temperature.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

A preferred embodiment of the present invention will now be described with reference to the accompanying drawings.

Figure 1:
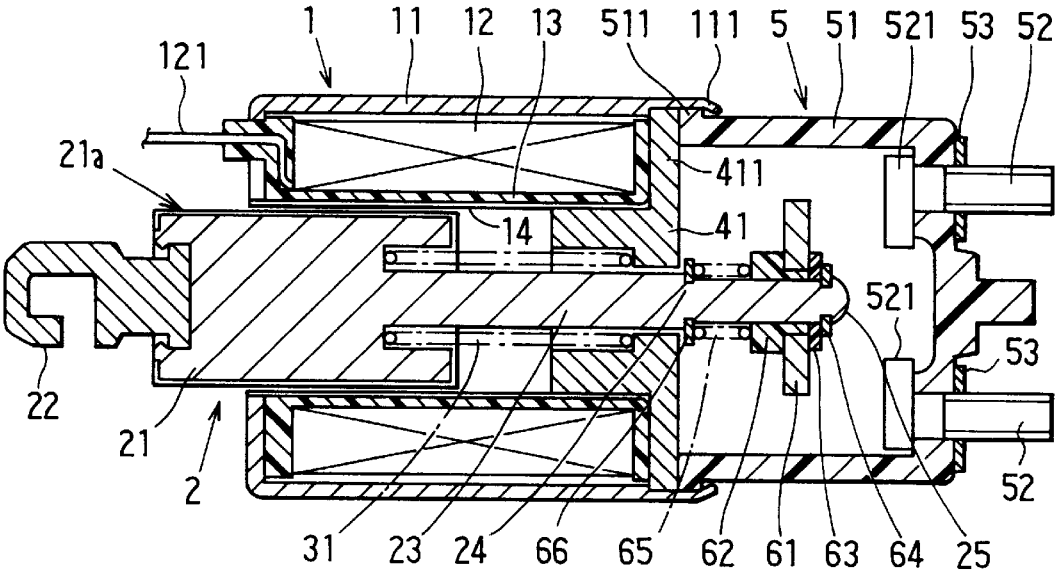
FIG. 1 is a sectional view of an electromagnetic switch according to a preferred embodiment of the present invention.

The preferred embodiment, in which the present invention is applied to an electromagnetic switch for an engine starter of an automobile, is shown in FIG. 1.

As shown in FIG. 1, the electromagnetic switch includes a coil unit 1, a core unit 2, and a switching unit 5.

The coil unit 1 has a solenoid coil 12 wound around a bobbin 13, and a pipe-shaped brass sleeve 14 fitted into an internal periphery of the bobbin 13, and a switch frame 11 made of mild steel to form a case covering the solenoid coil 12 and having an approximately cylindrical shape. One end (left side in FIG. 1) of the solenoid coil 12 is covered by and end portion of the switch frame 11. The other end (right side in FIG. 1) of the solenoid coil 12 is covered by a flange 411 of a fixed core made of mild steel.

The flange 411 of the fixed core 41 and a stepped portion 511 of a plastic cover 51 for the switching unit 5 are integrally fixed by caulking an end portion 111 of the switch frame 11. Accordingly, the coil unit 1 and the switching unit 5 are integrally fixed to form an outline of the electromagnetic switch of the embodiment.

The core unit 2 has a movable core 21, a steel hook 22, and a return spring 31 provided between the movable core 21 and the fixed core 41. The movable core 21 is made of mild steel, and a metal thin film 21*a* is formed on an outer peripheral surface of the movable core 21. The hook 22 is fixed at one end (left side in FIG. 1) of the movable core 21.

The hook 22 is a connecting member for connecting the movable core 21 to one end of a drive lever (not shown) in order to drive a pinion gear driven by a starter motor via the drive lever along a drive shaft.

The return spring 31 is a coil spring to return the movable core 21 when an electromagnetic force of the solenoid coil 12 disappears after the movable core 21 is sucked by energizing the solenoid coil 12.

A shaft 23, having an approximately cylindrical shape and concentrically formed with the movable core 21, protrudes from the other end (right side in FIG. 1) of the movable core 21, and penetrates a central through hole of the fixed core 41. A tip of the shaft 23 protrudes into an internal space of the cover 51, and sustains a movable contact 61 made of copper alloy via an insulating bush 62 and an insulating washer 63.

Since a stepped portion 24 is formed at an intermediate portion of the shaft 23, the diameter of the shaft 23 is reduced at the stepped portion 24. The stepped portion 24 is fitted into washer 66, and fixes one end of a contact pressure spring 65 to the shaft 23. The contact pressure spring 65 keeps pushing the movable contact 61 toward a fixed contact 521 via the insulating bush 62. The tip (right end in FIG. 1) of the shaft 23 has a smaller diameter with a step. A flat washer 64 for limiting a movable range of the movable contact 61 and the like is fixed to the tip of the shaft 23 by a caulking portion 25.

The switching unit 5 has the plastic cover 51 and a pair of terminal bolts 52 fixed at the bottom of the cover 51 by a caulking washer 53. The plastic cover 51 hermetically covers the tip of the shaft 23 and the movable contact 61. Fixed contacts 521 are formed on respective ends of the bolts 52 protruding to the internal space of the cover 51.

Accordingly, the electromagnetic switch of the embodiment has the solenoid coil 12, pipe-shaped sleeve 14, and the movable core 21. The solenoid coil 12 generates electromagnetic force when it is energized. The movable core 21 moves when it is attracted toward the solenoid coil 12, and the outer peripheral surface of the movable core 21 slides on the inner peripheral surface of the sleeve 14. The sleeve 14 is made of brass which has a small friction coefficient, a stability, and a high heat conductivity.

The metal thin film 21*a* is harder than brass which forms the sleeve 14, and has a melting point equal to or higher than 400° C. The ground for limiting the melting point higher than 400° C. is that a temperature at a sliding surface between the movable core and the sleeve may reach 300° C. according to a conventional electromagnetic switch for a starter, and the inventors considers that the safety margin of 100° C. might be necessary for higher performance of an improved future electromagnetic switch.

The metal thin film 21*a* is also a decorative chrome plating layer formed by continuous process of the electroplating. A precision-machine-finished surface of the outer periphery of the movable core 21 is nickel plated, and is chrome plated thereon. A thickness of the nickel plated layer is about 10 to 30 $\mu$m. A thickness of the chrome plated layer plated on the nickel plated layer is about 0.1 to 0.6 $\mu$m. Thus, a thickness of the metal thin film 21*a* is about 10 to 30 $\mu$m.

The melting point of the nickel forming the nickel plating layer is about 1450° C., and the melting point of the chrome forming the chrome plating layer is about 1860° C. Accordingly, the melting point of the metal thin film 21*a* is far beyond 400° C., and the metal thin film 21*a* has high heat resistance.

Figure 2:
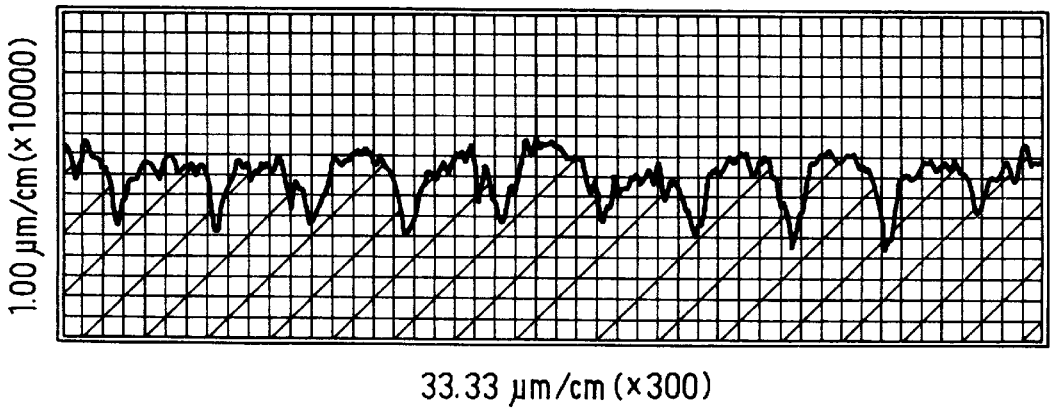
FIG. 2 is an enlarged view showing surface roughness of a movable core before forming a metal thin film according to the preferred embodiment.

As shown in FIG. 2, the ten-point-averaged roughness of the precision-machine-finished surface of the outer periphery of the movable core 21 is about Rz3Z before the decorative chrome plating, and it is not smooth enough as a sliding surface.

Figure 3:
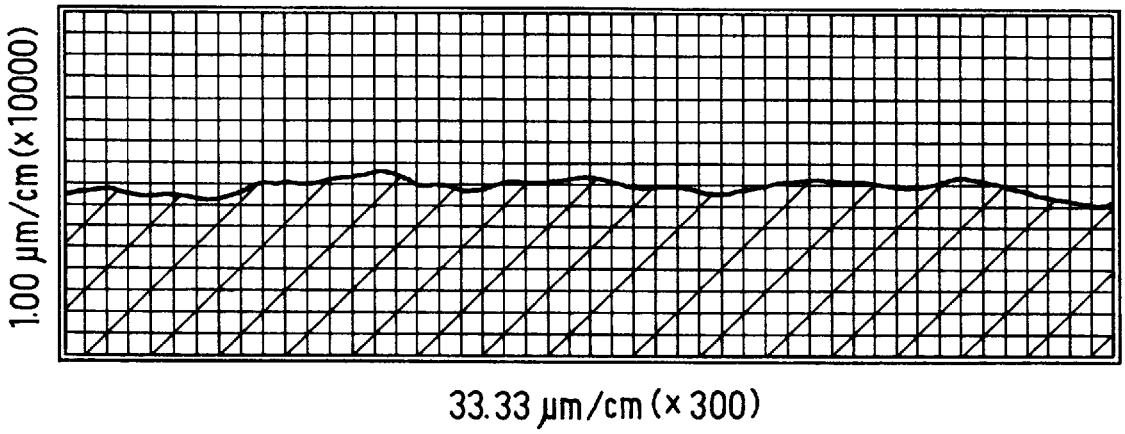
FIG. 3 is an enlarged view showing surface roughness of the movable core after forming the metal thin film according to the preferred embodiment.

As shown in FIG. 3, however, the ten-point-averaged roughness of the surface of the metal thin film 21*a* is about Rz0.5Z after the metal thin film 21*a* is formed by the decorative chrome plating. Accordingly, the surface of the metal thin film 21*a* has a smoothness less than Rz1Z in the ten-point-averaged roughness.

The surface hardness of the metal thin film 21*a* is about Hv500 in Vickers hardness, that is, higher than Hv400 in Vickers hardness. On the other hand, the surface hardness of the brass forming the sleeve 14 is about Hv100 in Vickers hardness. Thus, the surface hardness of the outer peripheral surface of the movable core 21 is approximately five times as hard as that of the inner peripheral surface of the sleeve 14 in Vickers hardness. The brass forming the sleeve 14 has a smooth surface like a mirror, and is a special brass including aluminum and nickel to improve the protection against corrosion under high temperature.

It is a reason for using the hard metal thin film 21*a* that a soft and self-lubricate material, such as Teflon (trademark) and molybdenum disulfide, disappears by abrasion and lacks of durability for long-term use.

Operations and advantages of the preferred embodiment of the present invention will now be described.

Firstly, when the solenoid coil 12 is energized via a lead 121, the solenoid coil 12 generates a ring-shaped electromagnetic force around it. Accordingly, the fixed core 41 is attracted toward the internal space of the solenoid coil 12 by the magnetic force. At that time, the strong magnetic attractive force is caused between the fixed core 41 and the movable core 21, and the movable core 21 is attracted to the fixed core 41 against the spring force of the return spring 31. Thus, the drive lever (not shown) is driven via the hook 22.

When the movable core 21 is attracted to the fixed core 41, the shaft 23 which is a part of the movable core 21 moves, and the movable contact 61 makes a contact with both fixed contacts 521 according to the spring force of the contact pressure spring 65. As a result, both fixed contacts 521 conducts each other, and a switch formed between them is closed.

Secondly, when the current supply to the solenoid coil 12 is turned off, the movable core 21 is returned to its original position (the state shown in FIG. 1) by the spring force of the return spring 31, and the drive lever also returns to its original position. Since the movable contact 61 is detached from the both of the fixed contact 521, the switch formed between the terminal bolts 52 is opened again.

During the above described operations, the outer peripheral surface of the movable core 21 slides on the inner peripheral surface of the sleeve 14. In other words, the metal thin film 21*a* slides on the inner peripheral surface of the sleeve 14 made of brass. At that time, the sleeve 14 and the metal thin film 21*a* may be exposed to high temperature of 300° C. caused by Joule heat generated at the solenoid coil 12. However, since the metal thin film 21*a* has the melting point much higher than 300° C. and the brass sleeve 14 has the high heat resistance, it does not melt.

The abrasion at the sliding surface includes abrasive wear (mechanical abrasion) and adhesive wear. According to the inventor's researches, he found out that the adhesive wear is dominant in the abrasion of the conventional electromagnetic switch. He also found that the adhesive wear is reduced when a hardness difference between the sliding members is greater, that is, the surface hardness of the metal thin film 21*a* is harder than the sleeve 14.

Figure 4:
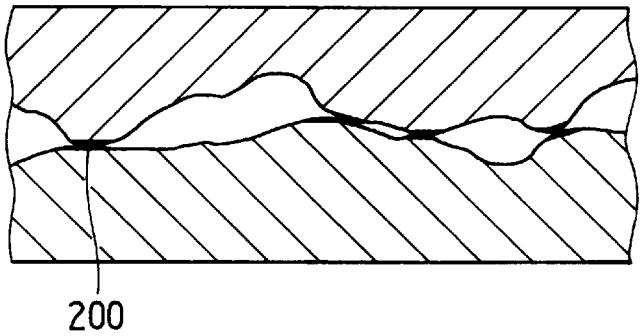
FIG. 4 is a schematic sectional view illustrating the concept of adhesive wear at a metal sliding portion.

As shown in FIG. 4, the adhesive wear is a phenomenon that protrusions at the sliding surface make a contact and adheres each other, and then the adhered portion 200 is sheared by abrasion. Friction force F caused by the adhesive wear is defined by the following equation;

$$F=S\cdot A$$

where the reference A represents an actual contact area between the contacting metals, and the reference S represents shearing strength of the adhered portion 200. Thus, an abrasion amount at the sliding surface is in proportion to the friction force F. Accordingly, the abrasion amount at the sliding surface is reduced by reducing the friction force F.

According to the embodiment of the present invention, it is important to prevent the adhesive wear for reducing the friction force F and for improving the sliding durability. It is another reason for reducing the friction force F that the electromagnetic switch is required to operate without fail even if the battery voltage for driving the electromagnetic switch is reduced from 12 Volts to 8 Volts.

According to the embodiment of the present invention, the metal thin film 21*a* has the extremely high smoothness on its surface and has the surface hardness several times higher than brass. Thus, the adhesive wear is reduced, and the sliding durability is extremely improved. The sliding durability is maintained under high temperature. The metal thin film 21*a* formed by the decorative chrome plating and the sleeve 14 formed by special brass not only improve the sliding durability but also improve the corrosion resistance under high temperature.

Furthermore, according to the embodiment of the present invention, the metal thin film 21*a* is formed by electroplating. Thus, the forming process is simple, and the manufacturing cost may be reduced.

The preferred embodiment of the present invention may be modified in various ways. For example, the sleeve 14 may be made of stainless steel instead of brass. The metal thin film 21*a* may be made of only chrome. Furthermore, instead of the electroplating, vacuum deposition, sputtering or the like may be used to form the metal thin film 21*a*.

When the electroplating is used, the metal thin film 21*a* is easily formed with high productivity and the lower cost. When the vacuum deposition is used, an extremely clean and smooth surface is obtained. When the sputtering is used, forming a thin film is precisely performed with an alloy with precision composition in addition to the advantage of the vacuum deposition. Further, according to the vacuum deposition or sputtering, a metal thin film made of amorphous alloy is easily formed.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An electromagnetic switch comprising:

a sleeve made of a first metal;

a solenoid coil disposed outside said sleeve for generating an electromagnetic force; and a movable core disposed inside said sleeve for being slid in said sleeve by said electromagnetic force, a part of said movable core being covered by a metal film made of a second metal having a melting point higher than 400° C. and having higher coefficient of hardness than said first metal, wherein said metal film comprises an inner plating layer made of nickel and an outer plating layer made of one of chrome and chrome alloy.

2. An electromagnetic switch as in claim 1, wherein a surface of said metal film has a smoothness less than or equal to Rz1Z in ten-point-averaged roughness.

3. An electromagnetic switch as in claim 1, wherein a surface of said metal film has a hardness higher than or equal to Hv400 in Vickers hardness.

4. An electromagnetic switch as in claim 1, wherein said inner nickel plating layer is plated on a precision-machine-finished surface of the outer periphery of said movable core.

5. An electromagnetic switch as in claim 1, wherein said second metal is formed by one of electroplating, vacuum deposition and sputtering.

6. An electromagnetic switch as in claim 1, wherein said electromagnetic switch is a switch for a starter of a vehicle.

7. An electromagnetic switch as in claim 1, wherein said inner nickel plating layer is thicker than said outer plating layer.

8. An electromagnetic device comprising:

a sleeve made of a first metal;

a solenoid coil wound around said sleeve for generating a magnetic force when energized;

a movable core fitted in said sleeve movably in response to said magnetic force; and a metal layer formed between said movable core and said sleeve, said metal layer being made of a second metal having a hardness higher than that of said first metal, wherein said metal film comprises an inner plating layer made of nickel and an outer plating layer made of one of chrome and chrome alloy.

9. An electromagnetic device as in claim 8, wherein said metal layer has a hardness higher than or equal to Hv400 in Vickers hardness.

10. An electromagnetic device as in claim 8, wherein said metal layer has a melting point higher than 400° C.

11. An electromagnetic device as in claim 8, wherein said inner nickel plating layer is plated on a precision-machine-finished surface of the outer periphery of said movable core.

12. An electromagnetic device as in claim 8, wherein said electromagnetic device is a device for a starter of a vehicle.

13. An electromagnetic device as in claim 8, wherein said inner nickel plating layer is thicker than said outer plating layer.

14. An electromagnetic switch comprising:

a sleeve made of a first metal;

a solenoid coil disposed outside said sleeve for generating an electromagnetic force; and a movable core disposed inside said sleeve for being slid in said sleeve by said electromagnetic force, a part of said movable core being covered by a metal film made of a second metal having a melting point higher than 400° C. and having higher coefficient of hardness than said first metal, wherein a surface of said metal film has a smoothness less than or equal to Rz1Z in ten-point-averaged roughness.

15. An electromagnetic switch as in claim 14, wherein said metal film comprises an inner plating layer being made of nickel and an outer plating layer being made of one of chrome and chrome alloy.

16. An electromagnetic switch as in claim 15, wherein said nickel plating layer is plated on a precision-machine-finished surface of the outer periphery of said movable core.

* * * * *